US006078771A

United States Patent [19]

Buchanan et al.

[11] Patent Number: 6,078,771

[45] Date of Patent: Jun. 20, 2000

[54] LOW FRICTION DOCTOR BLADE

[75] Inventors: John Andrew Buchanan; Benjamin Keith Newman, both of Lexington; Franklin Joseph Palumbo, Nicholasville, all of Ky.

[73] Assignee: Lexmark International, Inc., Lexington, Ky.

[21] Appl. No.: 09/401,150

[22] Filed: Sep. 22, 1999

[51] Int. Cl.[7] ..... G03G 15/08

[52] U.S. Cl. ..... 399/284; 118/261

[58] Field of Search ..... 399/284, 274, 399/126, 350, 351, 102, 103, 105; 118/261

[56] References Cited

U.S. PATENT DOCUMENTS

| | | | |
|---|---|---|---|
| 4,498,760 | 2/1985 | Sugiyama | 399/351 |
| 4,537,491 | 8/1985 | Kimada et al. . | |
| 4,548,490 | 10/1985 | Stirrat et al. . | |
| 4,566,776 | 1/1986 | Kondoh . | |
| 4,585,328 | 4/1986 | Moser et al. . | |
| 4,660,504 | 4/1987 | Weitzel . | |
| 4,695,153 | 9/1987 | Matsushita . | |
| 5,068,691 | 11/1991 | Nishio et al. | 399/284 |
| 5,202,728 | 4/1993 | Maeshima et al. . | |
| 5,233,390 | 8/1993 | Fujimoto . | |
| 5,260,748 | 11/1993 | Kahle . | |
| 5,303,010 | 4/1994 | Takano et al. . | |
| 5,389,732 | 2/1995 | Sekino . | |
| 5,412,458 | 5/1995 | Kamaji et al. | 399/284 X |
| 5,499,082 | 3/1996 | Sekino . | |
| 5,640,651 | 6/1997 | Katoh et al. . | |
| 5,737,676 | 4/1998 | Maeda et al. | 399/284 |

*Primary Examiner*—Sophia S. Chen
*Attorney, Agent, or Firm*—Michael T. Sanderson

[57] ABSTRACT

A device within an image forming apparatus for positioning a doctor blade against a developer roller and preventing toner leakage. The device includes a developer housing for containing the developer roller and the doctor blade. A biasing member is positioned adjacent to the doctor blade for forcing the doctor blade against the developer roller for controlling the mass flow and charge level of the toner. The doctor blade is supported by retention stops on a front edge and a pair of supports on the back edge. Toner is prevented from leaking through the device by a flap seal positioned along the doctor blade back side and a seal positioned between each end of doctor blade end and developer housing. The invention provides for the doctor blade to be freely positioned between the retention stops, developer housing, and seals providing for the doctor blade to contact the developer roller in a consistent manner.

17 Claims, 7 Drawing Sheets

LOW FRICTION DOCTOR BLADE

FIELD OF THE INVENTION

The present invention relates generally to an image forming apparatus and, more particularly, to a doctor blade positioned against a developer roller to evenly meter toner while preventing loss of toner.

BACKGROUND OF THE INVENTION

Image forming devices including copiers, laser printers, facsimile machines, and the like, include a drum having a rigid cylindrical surface that is coated along a defined length of its outer surface with a photoconductive material. The surface of the drum is charged to a uniform electrical potential and then selectively exposed to light in a pattern corresponding to an original image. Those areas of the photoconductive surface exposed to light are discharged thus forming a latent electrostatic image on the photoconductive surface. A developer material, such as toner, having an electrical charge such that the toner is attracted to the photoconductive surface is brought into contact with the member's photoconductive surface. The drum then rotates past an intermediate transfer medium where the toner is transferred onto the medium. A recording sheet, such as a blank sheet of paper, is then brought into contact with the intermediate transfer medium and the toner thereon is transferred to the recording sheet in the form of the latent electrostatic image. The recording sheet is then heated thereby permanently fusing the toner to it. In preparation for the next image forming cycle, the member's photoconductive surface is discharged and residual toner is removed.

The toner is stored in a toner reservoir adjacent to the drum. A doctor blade and developer roller are positioned between the toner reservoir and drum for controlling the amount of toner passed to the drum surface. The nip point created between the doctor blade and the developer roller controls the amount of toner transferred to the drum surface. Additionally, the developer roller and doctor blade are electrically charged to charge the toner as it passes through the nip point to assist in the transfer to the drum.

It is important that the doctor blade make uniform and consistent contact across the entire length of the developer roller. If the doctor blade has inconsistent pressure with the developer roller during the transfer, uneven toner amounts will be transferred to the drum resulting in inconsistent and unacceptable print quality. If too much toner is transferred to the drum, printing errors may occur such as blurred images, poor color, and toner particles deposited on the background areas. Conversely, if not enough toner is transferred to the drum, the images will be too light and difficult to see.

A problem in maintaining consistent contact and pressure is the developer roller profile may be non-uniform requiring that the doctor blade move inward and outward to track the surface of the developer roller. Additionally, it is vital that contact be maintained across the entire length of the doctor blade to ensure even print quality across the width of the image. Therefore, it is important that the doctor blade contact and "float" on the developer roller with a consistent amount of pressure for correct toner transfer and toner charge.

One type of previous design permanently mounts the doctor blade against a housing positioned adjacent to the developer roller surface. This design provides for the doctor blade placement to be constant regardless of the surface of the developer roller. However, this design does not address variations and irregularities in the developer roller surface resulting in greater or less amounts of toner to pass by the doctor blade to the drum surface.

Another design provides for the doctor blade to be positioned within a housing adjacent to the developer roller. The doctor blade is attached to the housing to secure the doctor blade in the proper position and angle relative to the developer roller surface. A biasing member positioned behind the doctor blade pushes the doctor blade against the developer roller. One drawback of this design is the doctor blade rubs against the housing during use resulting in friction between the surfaces. This friction reduces the effectiveness in metering toner because a portion of the force by the biasing member is required to overcome the friction and is not available to hold the doctor blade against the developer roller surface. Additionally, as the doctor blade moves inward and outward relative to the developer roller, the friction acts to dampen the blade movement, which results in inaccurate surface tracking.

Another drawback of previous designs is toner leakage around the doctor blade and housing. The contact surfaces between the doctor blade and the housing provide avenues for the toner to collect and pass through to the drum surface resulting in print defects. To overcome this problem, seals may be applied between the edges of the doctor blade and the housing to eliminate toner leakage. Unfortunately, the seals affect the movement of the blade against the developer roller resulting in yet additional force requirement to push the blade against the roller. Additionally, putty is often applied to these areas to further assist in blocking any openings. However, putty causes additional friction between the doctor blade and housing.

Thus, there remains a need for a doctor blade that floats on the developer roller providing consistent toner amounts to be passed to the drum surface.

SUMMARY OF THE INVENTION

The present invention provides for positioning a doctor blade against a developer roller within an image forming apparatus. The doctor blade is held in position adjacent to the developer roller along first and second ends by a developer housing for controlling lateral movement. A pair of retention posts and retention blocks are positioned along the front side of the doctor blade, and a pair of supports are positioned along the back side to control the angular position of the doctor blade relative to the developer housing. A pair of stop members are positioned above the doctor blade opposite the developer roller to control the maximum movement of the doctor blade away from the developer roller. These elements contain the doctor blade relative to the developer roller without being attached to otherwise inhibit the movement of the doctor blade. These members are preferably constructed of a low friction material that provides for the doctor blade to freely move and stay in contact with the developer roller. A biasing member forces the doctor blade against the developer roller and controls the pressure at a nip point to control the mass flow and charge level of the transferred toner.

The invention may also prevent toner from leaking from the toner reservoir to the drum. A flap seal is positioned along the back edge of the doctor blade to prevent toner from leaking over the top edge of the doctor blade. Additional, seals are positioned at the contact points between the developer housing and the developer roller. These seals contact the doctor blade to prevent toner leakage, and are preferably constructed of a low friction material such that the movement of the doctor blade is not restricted.

DETAILED DESCRIPTION OF THE PREFERRED EMBODIMENTS

Figure 1:
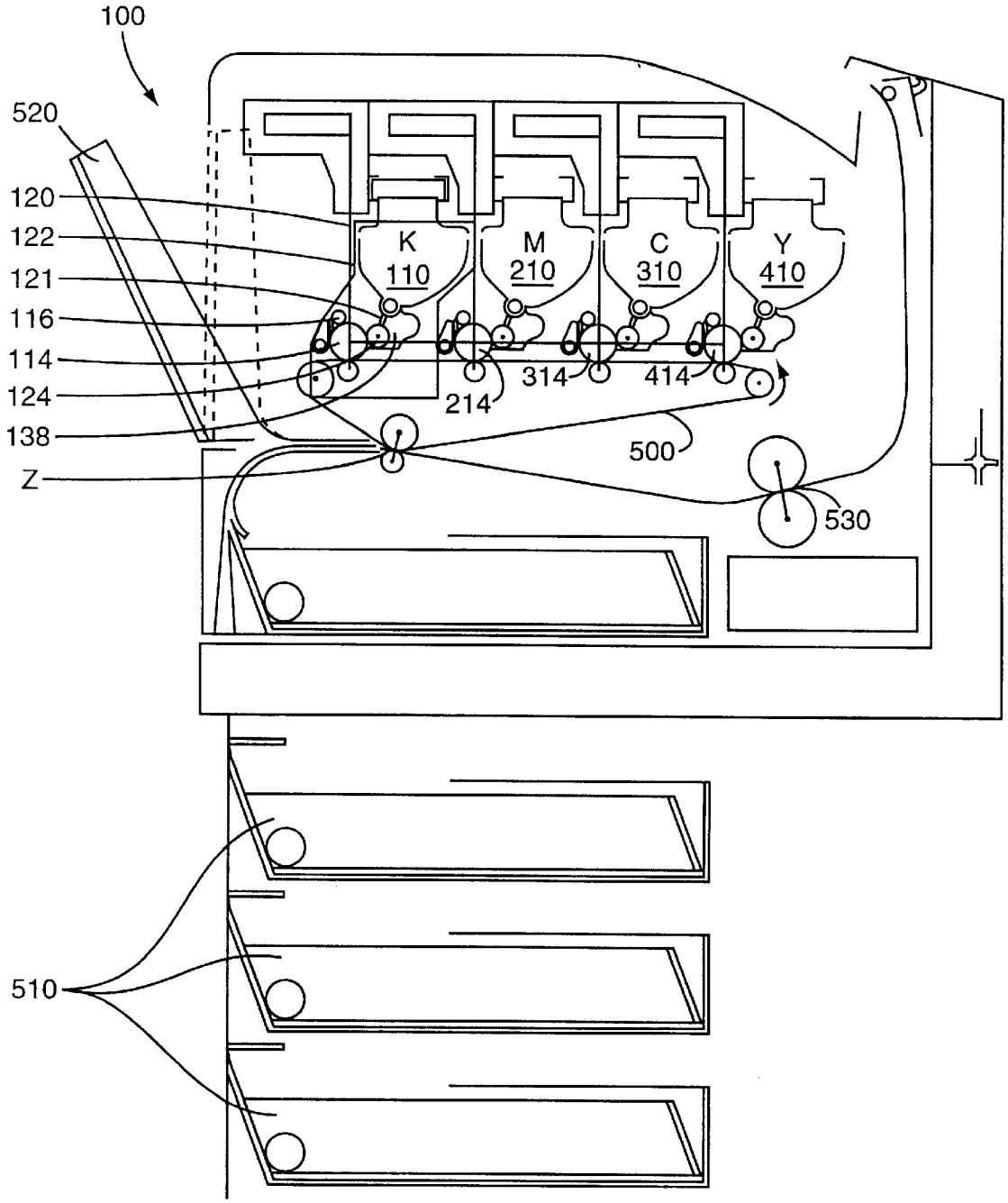
FIG. 1 is a side view illustrating the elements of an image forming apparatus and the positioning of the doctor blade and developer roller.

FIG. 1 illustrates the basic elements of an image forming device and is incorporated for an understanding of the overall electrophotographic image forming process. A color laser printer is illustrated as 100, however, one skilled in the art will understand that the present invention is applicable to other types of image forming devices using toner for printing through a photoconductive drum. The image forming apparatus, generally designated 100, includes a plurality of similar toner cartridges 110, 210, 310, and 410. Each toner cartridge has similar construction but is distinguished by the toner color contained therein. In the preferred embodiment, the device includes a black cartridge 110, a magenta cartridge 210, a cyan cartridge 310, and a yellow cartridge 410. The different color toners form individual images of a single color that are combined in layered fashion to create the final multi-colored image.

Each of the toner cartridges is substantially identical and includes a drum, a transfer device, and a cleaning device. As the cartridges are respectively identical except for the toner color, the cartridge and elements for forming black images will be described, with the other color image forming units being omitted for simplification.

The drum 114 is generally cylindrically-shaped with at least one end having gears or spokes for intermeshing with the image forming device drive gears to provide for a rotational force. The drum 114 has a smooth surface for receiving an electrostatic charge over the surface as the drum rotates past charging roller 116. The drum 114 uniformly rotates through a laser scanning assembly 120 that directs a laser onto a selected portion of the drum surface forming an electrostatically latent image across the width of the drum representative of the outputted image. A drive gear rotates the drum at a constant speed as the laser is scanned across the width segment. This process continues as the entire image pattern is formed on the drum surface.

After receiving the latent image, the drum rotates through a toner area having a toner bin 122 and a lower toner reservoir 138 for housing the toner. A developer roller 124 is positioned adjacent to the doctor blade and rotates to transfer the toner from the lower toner reservoir 138 to the drum 114. The doctor blade 121 is biased against the developer roller 124 at a nip point that controls the amount of toner transferred to the drum 114. Additionally, both the developer roller 124 and doctor blade 121 are electrically charged to place a charge on the toner that passes through the nip point to further assist in the transfer. It is important that the doctor blade 121 continuously maintain contact or float against the developer roller 124 to maintain consistent pressure providing for a consistent amount of toner transfer and also providing a consistent charge to the toner. The toner is a fine powder usually constructed of plastic granules that are attracted and cling to the areas of the drum that have been discharged by the laser scanning assembly 120.

The drum next rotates past an adjacently-positioned intermediate transfer medium belt 500 (hereinafter, ITM belt) where the toner is transferred from the drum 114. As illustrated in FIG. 1, the ITM belt 500 is endless and extends around a series of rollers adjacent to the drums. The ITM belt 500 and the image on each drum 114, 214, 314, 414 are synchronized providing for the toner from each drum to precisely align on the ITM belt during a single pass. By way of example as viewed in FIG. 1, the yellow (Y) toner will be placed on the ITM belt, followed by cyan (C), magenta (M), and black (B). After depositing the toner on the ITM belt, the drum rotates through a cleaning area where residual toner is removed from the surface via a brush or scraper 126.

As the drums are being charged and gathering toner, a recording sheet, such as blank sheet of paper, is being routed to intercept the ITM belt 500. The paper may be placed in one of the lower trays 510, or introduced into the image forming device through a side track tray 520. A series of rollers and belts transports the paper to point Z where the sheet contacts the ITM belt and receives the toner. Preferably, voltage is applied to one of the rollers that pushes the sheet of paper against the ITM belt at point Z to pull the charged toner away from the belt and onto the paper. The sheet and attached toner next travel through a fuser 530 having a pair of rollers and a heating element that heats and fuses the toner to the sheet. The paper with fused image is then transported out of the printer for receipt by a user.

Figure 2:
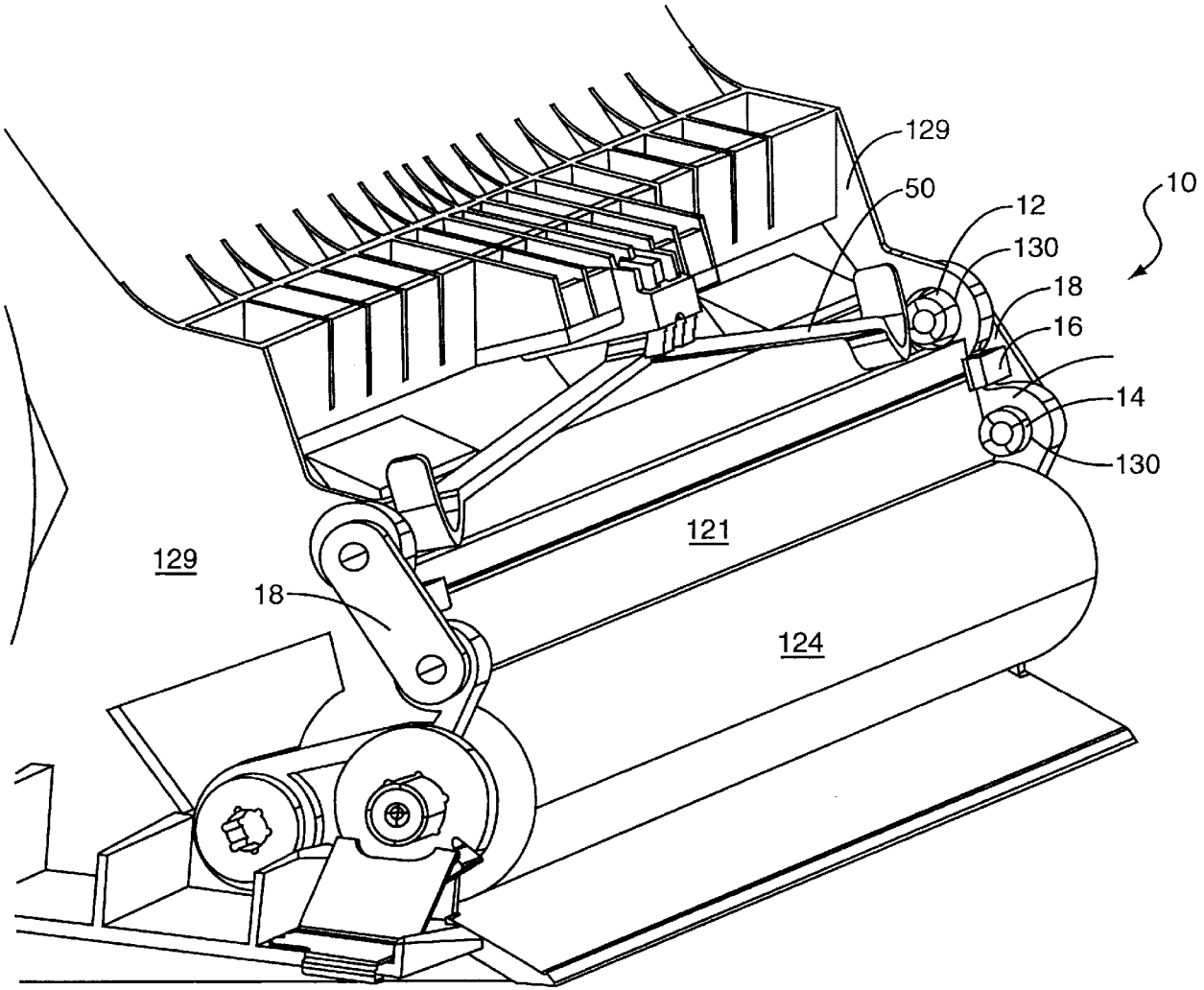
FIG. 2 is a perspective view illustrating a front side of the doctor blade positioned against the developer roller in accordance with the present invention.

FIG. 2 illustrates the doctor blade 121 positioned against the developer roller 124. An up-stop/retention device, generally designated 10, positions the doctor blade 121 and includes a stop post 12 for controlling the amount of doctor blade movement away from the developer roller 124. A retention post 14 and retention block 16 contact and position the doctor blade 121 relative to the developer roller 124.

The stop post 12 is positioned above the doctor blade 121 opposite the developer roller 124 and functions to control the maximum movement of the doctor blade 121 away from the developer roller 124. The stop post 12 is especially effective for safety concerns during handling of the cartridge to keep the doctor blade within the cartridge. By way of example, if the cartridge is dropped, the stop post 12 prevents the doctor blade 121 from separating from the developer housing 129 and possibly damaging the cartridge, image forming apparatus, or injuring a person handling this equipment.

A biasing member 50 attached to the developer housing 129 is positioned above the doctor blade to maintain a continuous force for biasing the lower edge 125 of the doctor blade against the developer roller 124. The drawings illustrate the doctor blade 121 substantially perpendicular to the developer roller, however, other orientations may also provide for transfer of proper toner amounts. Preferably, the biasing member 50 contacts the doctor blade 121 at more than one location along the doctor blade to ensure an even and distributed force is applied across the entire width of the developer roller 124. In one embodiment, the biasing member 50 provides about 1400 grams of force to the developer roller 124.

The retention post 14 and retention block 16 function to maintain the doctor blade 121 in the proper orientation with the doctor blade lower edge 125 positioned against the developer roller 124. As the developer roller 124 rotates in the direction illustrated by arrow 100 in FIG. 4, the doctor blade 121 is pushed against the retention post 14 and retention block 16. The post 14 and block 16 work in combination and the doctor blade 121 may contact only one or both during the toner transfer process. Both the stop post 12 and retention post 14 are illustrated as having a generally circular cross-sectional shape and the retention block 16 has a generally rectangular shape. However, other shapes may also function to effectively control the positioning of the doctor blade 121 providing the shapes do not cause friction with the doctor blade that would restrict the movement against the developer roller 124.

Figure 3:
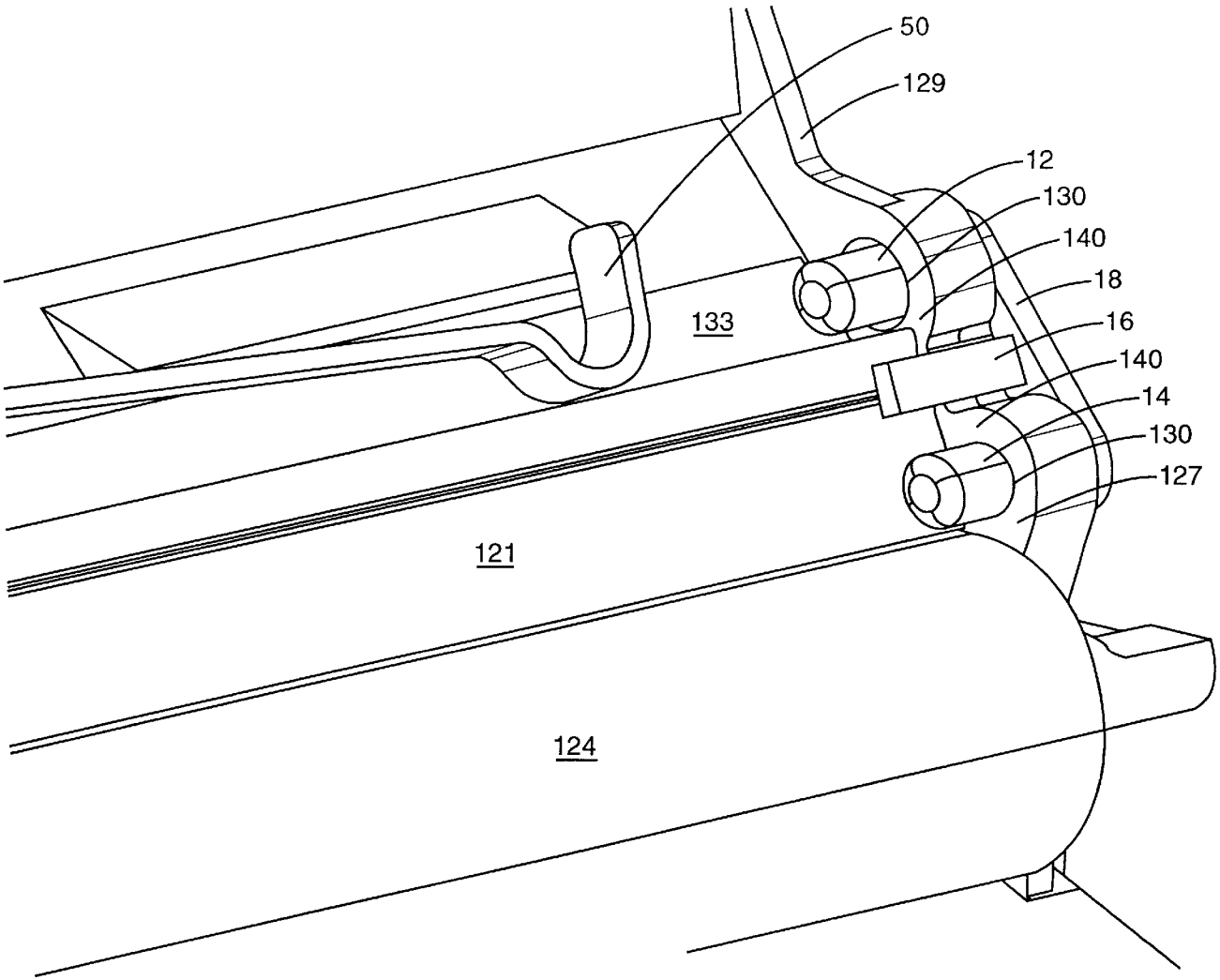
FIG. 3 is a partial perspective view illustrating the edge of the doctor blade seated against the developer housing with the stop post, retention post, and retention block.

The stop post 12, retention post 14, and retention block 16 may be constructed as a unitary piece having a common back section 18. Preferably, the piece is constructed of a low friction material, and in one preferred embodiment the piece is constructed from acetal. As illustrated in FIGS. 2 and 3, the back section 18 does not contact the doctor blade 121 but is positioned behind the developer housing 129. The stop post 12 and retention post 14 extend through openings 130, and the retention block 16 extends around the edge of the developer housing 129. The distance the stop post 12, retention post 14, and retention block 16 extend outward from the back section 18 may vary providing they extend through and around the developer housing for maintaining the position of the doctor blade 121.

Figure 7:
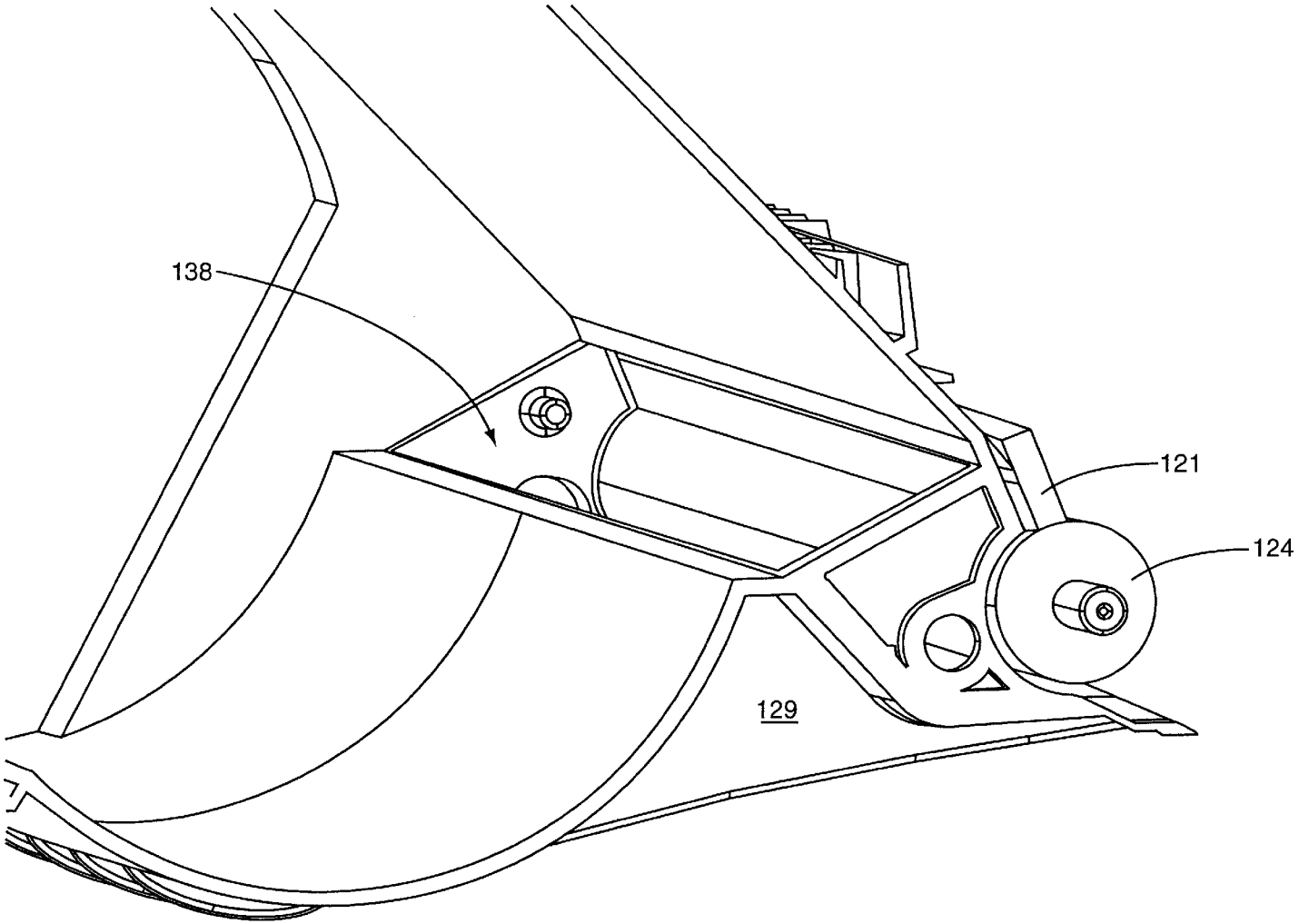
FIG. 7 is a perspective view illustrating the lower toner reservoir adjacent to the doctor blade and developer roller.

The developer housing 129 functions to contain the toner and provide a structure for mounting the doctor blade 121 and developer roller 124. As illustrated in FIGS. 1 and 7, a lower toner reservoir 138 houses the toner adjacent to the developer roller 124 and doctor blade 121. The lower toner reservoir 138 extends the entire length of the developer roller 124 to ensure toner is transferred across the entire length of the roller. The developer housing 129 further extends along the outer edges of the doctor blade 126 as illustrated in FIGS. 2 and 3. The developer housing has an inner side wall 140 that provides for laterally maintaining the doctor blade 121 over the developer roller 124. The developer housing 129 further includes a pair of apertures 130 for mounting the stop post 12 and retention post. The developer housing 129 may be constructed of any rigid material for supporting the toner and doctor blade 121, and in one embodiment is constructed of polystyrene.

Preferably, the inner side wall 140 further includes a seal (not shown) positioned where the doctor blade 121 contacts the inner side wall for ensuring toner does not leak between these elements. In one embodiment, a polyester film seal is positioned along the inner side wall 140, or positioned within an indent within the side wall for placement adjacent to the doctor blade 121.

Figure 6:
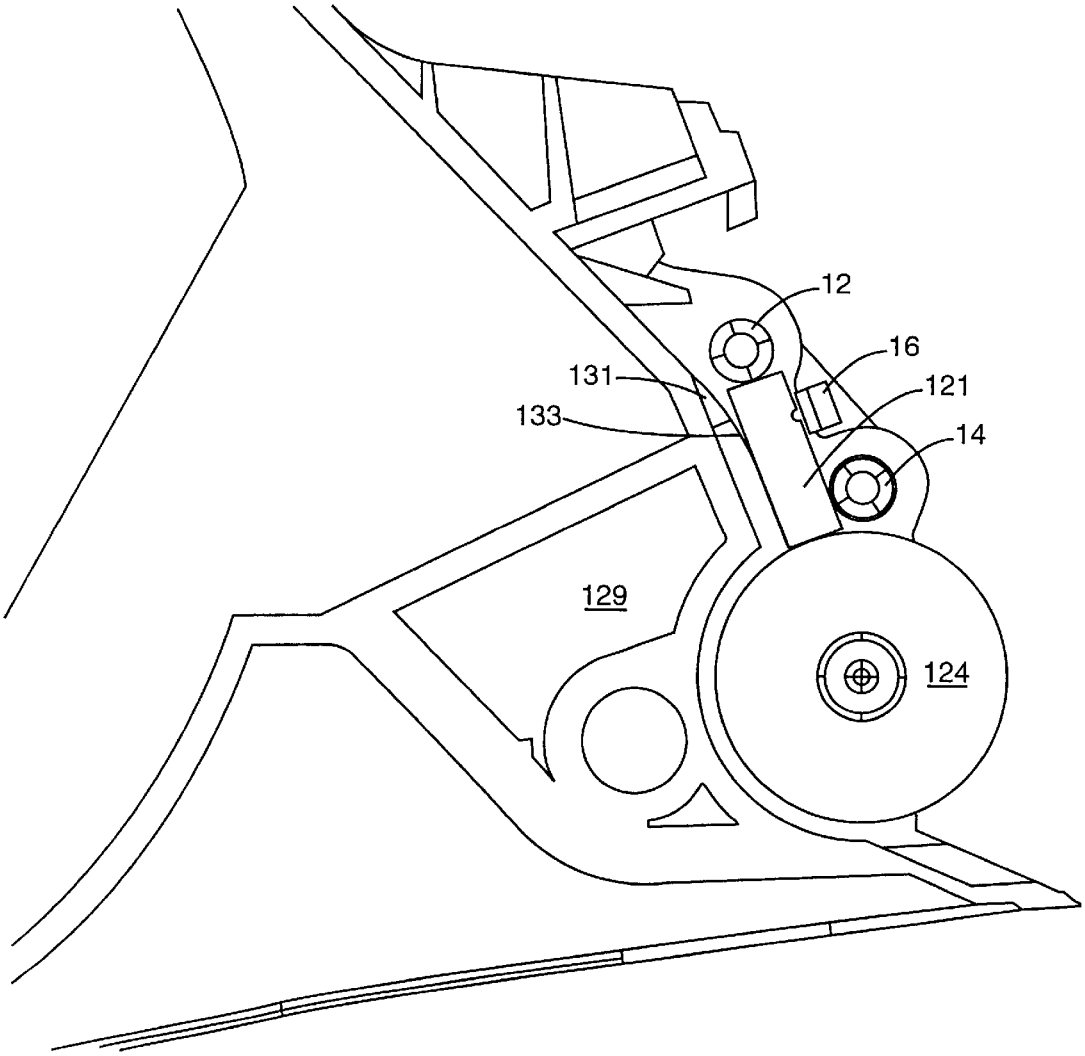
FIG. 6 is a side view illustrating the doctor blade and developer roller mounted within the developer housing.

As illustrated in FIG. 6, a support 131 extends outward from the developer housing 129 for supporting the back edge of the doctor blade. Preferably, a support 131 is positioned adjacent to each edge of the doctor blade 121 to act in combination with the retention post 14 and retention block 16 to maintain the orientation of the doctor blade. As the developer roller 124 rotates, the doctor blade 121 may shift relative to the developer roller between the retention post 14, retention block 16, and support 131. In the embodiment illustrated in FIG. 6, the support 131 has a substantially triangular shape, although other shapes and sizes may also be used.

A flap seal 133 extends along the back side of the doctor blade 121 to prevent the toner from leaking from the lower toner reservoir 138 to the developer roller 124 and ultimately the drum 114. The flap seal 133 includes an upper edge 134 that is attached to the developer housing to prevent toner from leaking across the top edge 127 of the doctor blade. A bottom edge 132 extends along the doctor blade to prevent toner from leaking along the back edge of the doctor blade. The flap seal 133 is positioned against the back edge of the doctor blade, but is not attached as this would inhibit the doctor blade 121 from floating against the developer roller 124. As illustrated in FIG. 6, the flap seal 133 is positioned between the supports 131 and the doctor blade 121. The material of the flap seal provides for a low to zero friction contact between the doctor blade 121 both at the bearing surface at the supports 131 and along the doctor blade length. Preferably, the flap seal is constructed of a polyester film such as that sold under the trademark Mylar by DuPont. However, other low friction materials may also be used.

Figure 4:
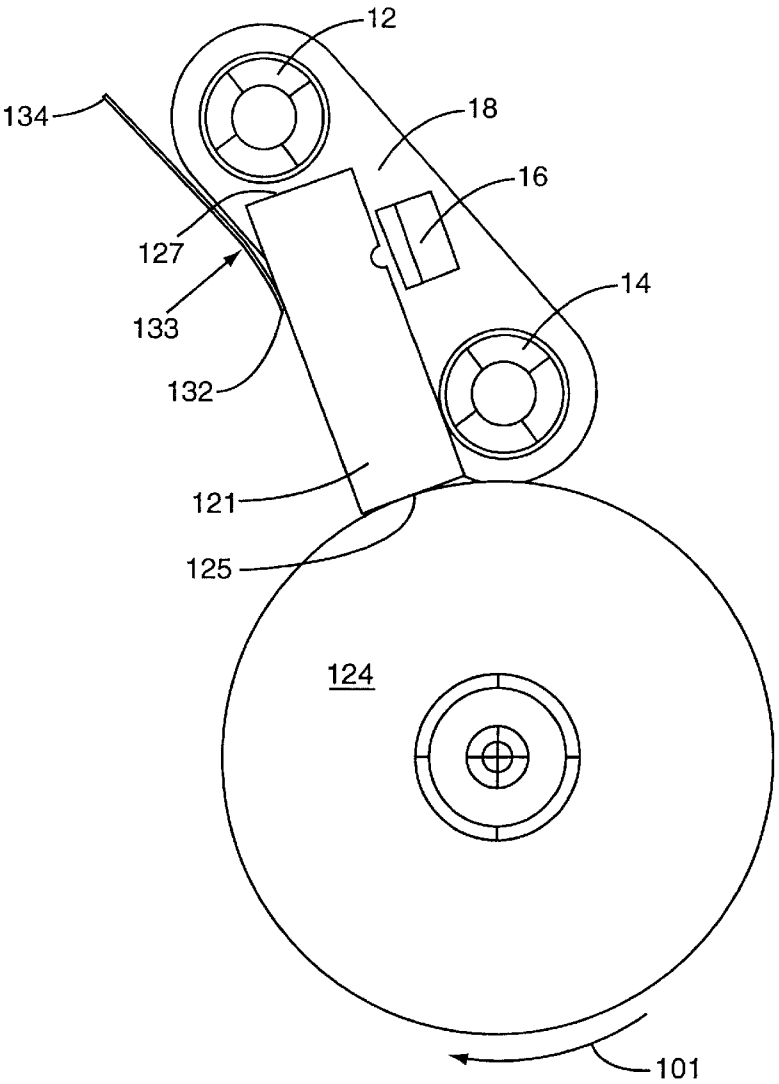
FIG. 4 is a side view illustrating the doctor blade and the developer roller removed from the developer housing.
Figure 5:
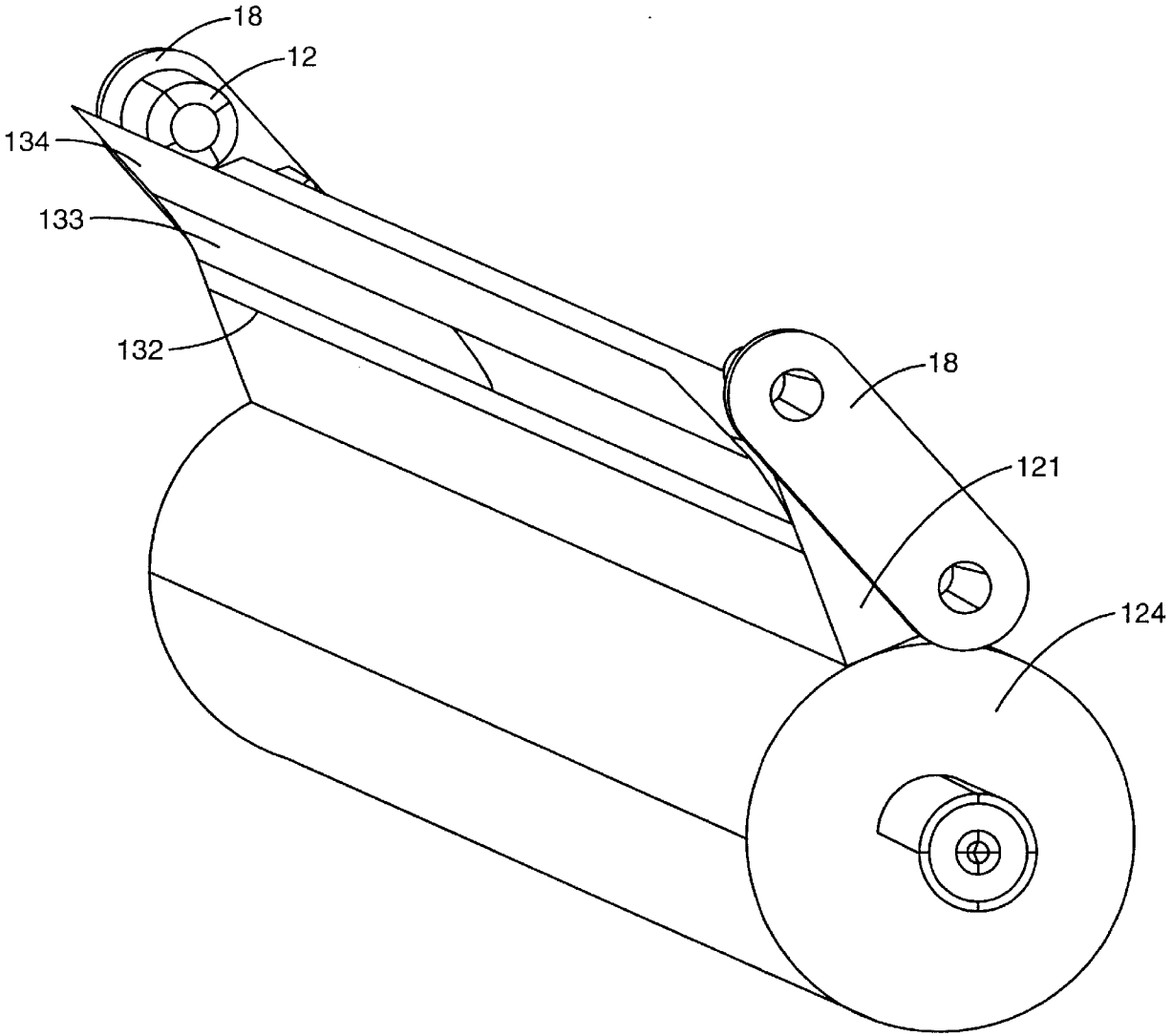
FIG. 5 is a perspective view removed from the developer housing of the doctor blade and developer roller having a flap seal positioned along the back edge of the doctor blade.

In use, as the developer roller rotates in the direction of arrow 100 illustrated in FIG. 4, toner from the lower toner reservoir 138 is transferred at the nip point between the lower edge 125 of the doctor blade and the developer roller 124. The pressure of the doctor blade 121 against the developer roller 124 controls the mass flow and charge level of the toner. The biasing member 50 provides a predetermined force on the doctor blade that is transferred to the nip point. Because of non-uniform profile of the developer roller 124, the doctor blade 121 may move in and out. Because there is little to no friction between the doctor blade 121 and any surface, the force of the biasing member 50 is transferred directly to the nip point to provide a consistent pressure resulting in uniform toner amounts and toner charge being passed to the drum 114. The doctor blade is not restricted by any of the components maintaining its position or sealing the toner and can thus effectively float on the surface of the developer roller. The doctor blade 121 may be positioned at a variety of angles relative to the developer roller 124.

EXAMPLE

Testing was performed to determine the amount of friction between the edges of the doctor blade and the sides of the developer housing. Gear side refers to the side of the cartridge mounted to the drive gears when the cartridge is inserted into the image forming apparatus. Likewise, the non-gear side is the side positioned away from the drive gears when mounted in the cartridge.

| Cartridge Serial No. | Gear Side (g) | Non-Gear Side (g) |
|---|---|---|
| 1 | 140 | 210 |
| 2 | 125 | 200 |
| 3 | 135 | 215 |
| 4 | 210 | 320 |
| 5 | 125 | 210 |
| 6 | 175 | 250 |
| 7 | 130 | 250 |
| 8 | 110 | 180 |
| 9 | 125 | 225 |
| 10 | 125 | 170 |
| 11 | 100 | 150 |
| 12 | 175 | 250 |
| 13 | 150 | 225 |
| X1 | 0 | 0 |
| X2 | 0 | 0 |

Using cartridge 1, 350 (140+210) grams of force is required to overcome the friction between the doctor blade and the developer housing to maintain contact with the developer roller. Therefore, if the spring provides about 1400 grams of force against the doctor blade, only 1,050 grams of force is being transferred to the developer roller. However, in the X1 and X2 embodiments constructed according to the present invention, the friction against the doctor blade has been eliminated resulting in the force of the spring being transferred directly to the developer roller without any loss.

The friction resulting in cartridges 1–13 was mainly caused by the seals extending between the doctor blade and the developer housing, and putty inserted along the seals to further prevent toner leakage. Because the new design eliminates these seals and the need for putty, there was no friction between these parts.

In this description, like-reference characters designate like or corresponding parts throughout the several views. Also in the following description, it is to be understood that such terms as "forward," "rearward," "left," "right," "upwardly," "downwardly," and the like, are words of convenience and are not to be construed as limiting terms. Certain modifications and improvements will occur to those skilled in the art upon a reading of the foregoing description. It should be understood that all such modifications and improvements have been deleted for the sake of conciseness and readability but are properly within the scope of the following claims.

What is claimed is:

1. A retainer for positioning a doctor blade against a developer roller within an image forming apparatus, said retainer comprising:

a. a front retention member positioned adjacent to a front side of the doctor blade;

b. a top retention member positioned on a top edge of the doctor blade; and c. a biasing member to bias the doctor blade against the developer roller; wherein the doctor blade is moveably contained within the retainer and rotation of the developer roller biases the doctor blade against said front retention member to maintain the orientation of the doctor blade and allow the doctor blade to track the developer roller.

2. The retainer of claim 1, further including side walls positioned against first and second doctor blade ends to position the doctor blade against the developer roller.

3. The retainer of claim 1, further including at least one support positioned on a back side of the doctor blade for maintaining the orientation of the doctor blade.

4. The retainer of claim 3, further including a seal contacting the doctor blade along the back side to prevent toner leakage, said seal extending between the doctor blade and said at least one support.

5. The retainer of claim 1, wherein said front retention member and said top retention member are a unitary piece.

6. A retainer for positioning a doctor blade within an image forming apparatus, said retainer comprising:

a. a housing extending along each end of the doctor blade;

b. a pair of retention members connected to said housing and positioned in proximity to each end of the doctor blade, each of said retention members having a retention post positioned adjacent to a front edge of the doctor blade; and c. at least one support positioned adjacent to a back edge of the doctor blade; wherein the doctor blade is freely contained between said housing, retention members, and at least one support to freely maintain contact with a developer roller.

7. The retainer of claim 6, wherein each of said retention members further includes a retention block positioned adjacent to the doctor blade front edge for controlling the positioning of the doctor blade.

8. The retainer of claim 7, wherein each of said retention members further includes a stop post positioned above the doctor blade opposite the developer roller to control the movement of the doctor blade from the developer roller.

9. The retainer of claim 8, wherein each of said retention members is constructed of acetal.

10. The retainer of claim 6, further including a biasing member for pushing the doctor blade against the developer roller.

11. The retainer of claim 10, wherein said biasing member pushes the doctor blade against the developer roller with a force of about 1400 grams.

12. The retainer of claim 6, further including a flap seal positioned along the doctor blade back edge for preventing toner escape, said flap seal extending between said at least one support and the doctor blade.

13. The retainer of claim 12, wherein said flap seal is constructed of a polyester film.

14. The retainer of claim 6, wherein a seal is mounted to said housing adjacent the doctor blade ends for preventing toner leakage.

15. A device for transferring toner to a developer roller and preventing toner leakage within an image forming apparatus comprising:

a. a developer housing;

b. a doctor blade positioned within the developer housing, said doctor blade having lateral edges and longitudinal edges with a first lateral edge being positioned to contact the developer roller for controlling the toner amount transferred from a toner reservoir to the developer roller;

c. retention members positioned along front and back sides of said doctor blade for positioning said doctor blade;

d. a biasing member contacting a second lateral edge of said doctor blade for forcing said first lateral edge doctor blade against the developer roller; and e. a flap seal positioned along said doctor blade back side for preventing toner leakage from said toner reservoir;

f. wherein said doctor blade is freely positioned between said retention members and said developer housing providing for said doctor blade first lateral edge to contact the developer roller.

16. The device of claim 15, wherein said doctor blade is angled between about 0 and 90 degrees relative to the developer roller.

17. The device of claim 16, wherein said biasing member supplies about 1400 grams of force to said doctor blade.

* * * * *